United States Patent [19]

Cipriani

[11] Patent Number: 4,951,543

[45] Date of Patent: Aug. 28, 1990

[54] INCREASED TORQUE BRIDGE FOR GUITARS

[76] Inventor: Thomas J. Cipriani, 640 E. Park Ave., Long Beach, N.Y. 11561

[21] Appl. No.: 213,157

[22] Filed: Jun. 29, 1988

Related U.S. Application Data

[63] Continuation-in-part of Ser. No. 39,941, Apr. 20, 1987.

[51] Int. Cl.[5] ..... G10D 3/04; G10D 3/12

[52] U.S. Cl. ..... 84/298; 84/291; 84/293

[58] Field of Search ..... 84/298, 299, 307, 291, 84/293

[56] References Cited

U.S. PATENT DOCUMENTS

| | | | |
|---|---|---|---|
| 447,689 | 3/1891 | Lenzner | 84/298 |
| 455,221 | 6/1891 | Lorang | 84/298 |
| 466,501 | 1/1892 | Lyon | 84/307 X |
| 559,301 | 4/1896 | Merrill | 84/292 |
| 601,071 | 3/1898 | Borcur | 84/298 |
| 835,085 | 11/1906 | Webb | 84/298 |
| 934,678 | 9/1909 | Laurian | 84/298 |
| 1,190,929 | 7/1916 | Marx | 84/307 |
| 1,764,679 | 6/1930 | Gart | 84/262 X |
| 2,247,565 | 7/1941 | Wagner | 84/299 |
| 2,491,788 | 12/1949 | Widowson | 84/298 |
| 3,018,680 | 1/1962 | Paul | 84/307 X |
| 3,290,980 | 12/1966 | Fender | 84/307 |
| 3,453,920 | 7/1969 | Scherer | 84/1.16 |
| 3,494,241 | 2/1970 | Jones | 84/307 |
| 3,974,730 | 8/1976 | Adams, Jr. | 84/291 |
| 4,027,570 | 6/1977 | Rendell et al. | 84/293 |
| 4,178,827 | 12/1979 | Mallory | 84/291 |
| 4,248,126 | 2/1981 | Lieber | 84/299 |
| 4,361,068 | 11/1982 | Sohaller | 84/299 |
| 4,425,832 | 1/1984 | Peavey | 84/298 |
| 4,430,919 | 2/1984 | Matsui | 84/299 |
| 4,464,970 | 8/1984 | Mischakoff | 84/298 |
| 4,541,320 | 9/1985 | Sciuto | 84/298 |
| 4,768,414 | 9/1988 | Wheelwright | 84/298 |

FOREIGN PATENT DOCUMENTS

| | | | |
|---|---|---|---|
| 2450010 | 4/1976 | Fed. Rep. of Germany | 84/307 |
| 2825051 | 12/1978 | Fed. Rep. of Germany | 84/298 |
| 452570 | 8/1936 | United Kingdom | 84/299 |

*Primary Examiner*—Lawrence R. Franklin
*Attorney, Agent, or Firm*—Ladas & Parry

[57] ABSTRACT

Bridge for improving volume, power and sustaining quality in a stringed musical instrument of the type having a hollow body over which are stretched substantially parallel strings, each string being stretched. The string height is raised over the sound board. One end of string may be anchored to a crossbrace on the underside of the sound board so as to directly vibrate this sound board. It also incorporates a means for string length fine tuning. The result is increased sound, volume and resonance persistence which is without distortion that may result in increased amplification when applied to guitars or other stringed instruments.

22 Claims, 15 Drawing Sheets

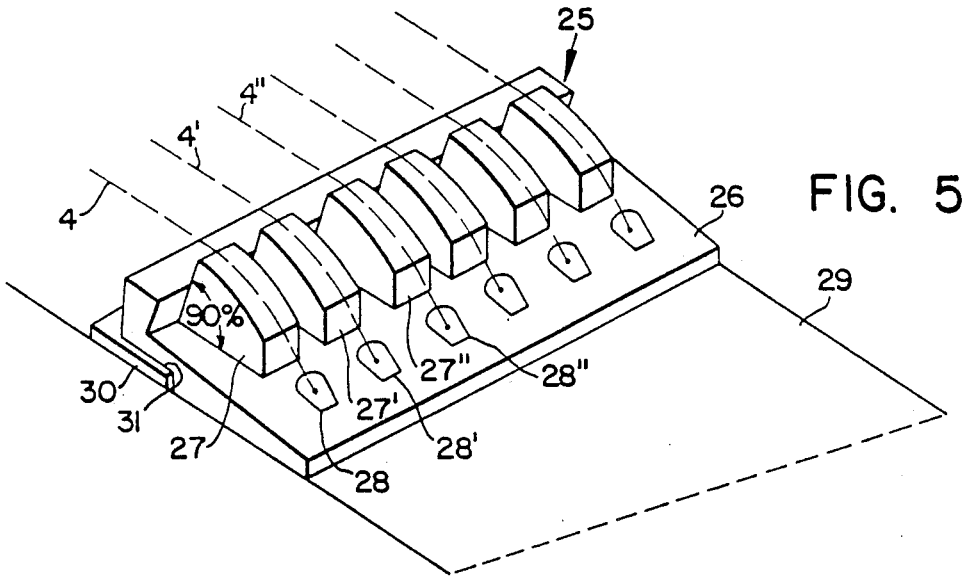
FIG. 5
FIG. 7
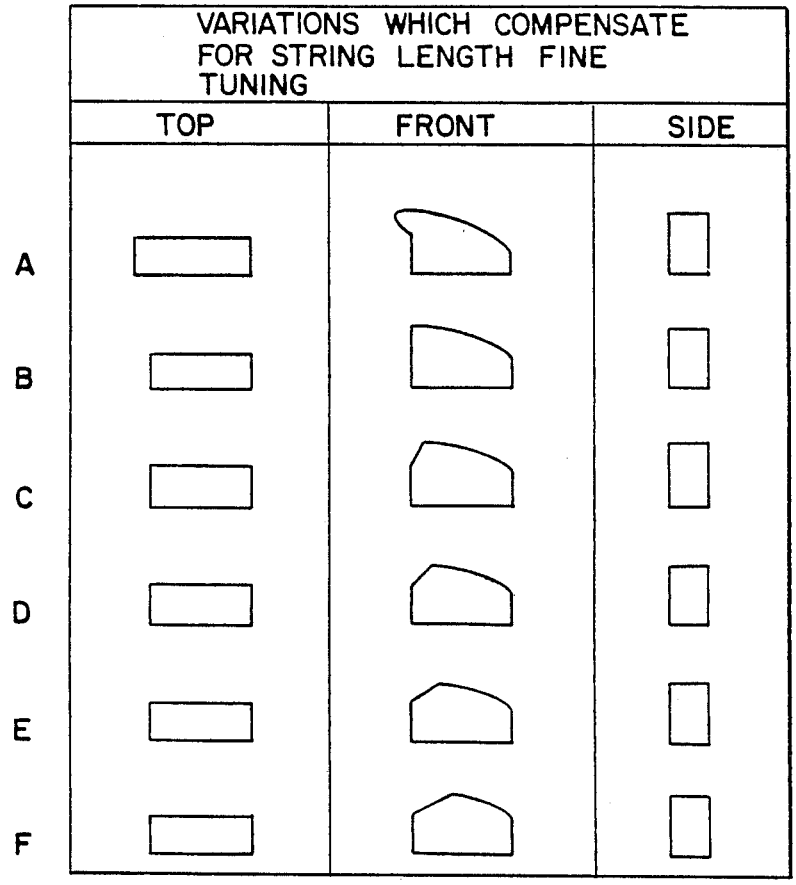

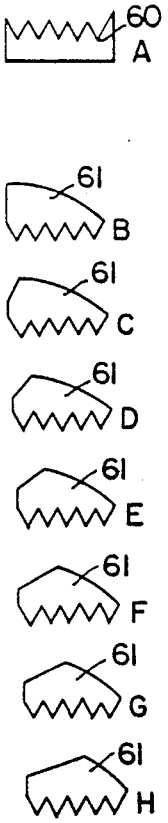
FIG. 8
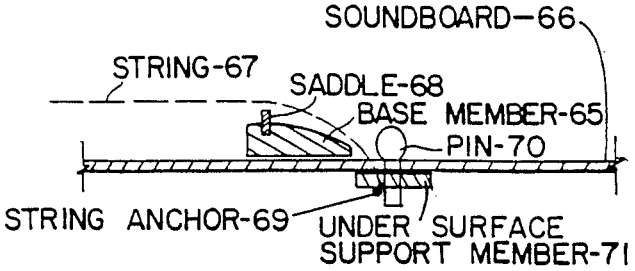
FIG. 10
FIG. 11
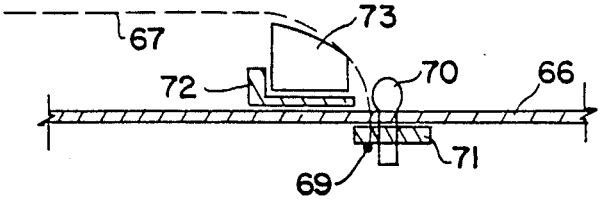
FIG. 12
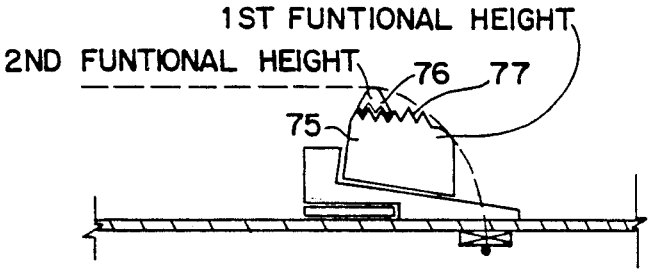
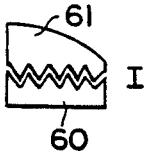
FIG. 9
FIG. 13
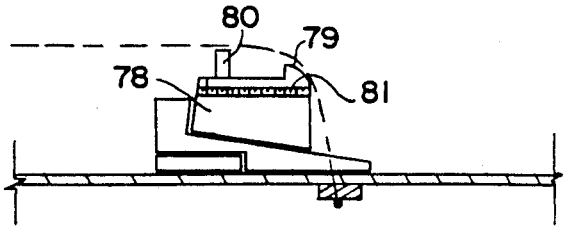

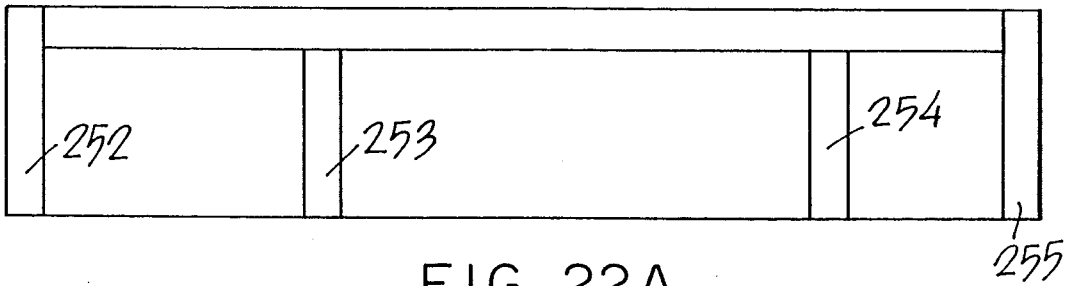
FIG. 22A
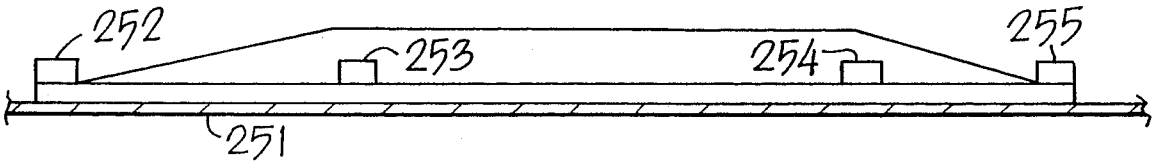
FIG. 22
FIG. 22B
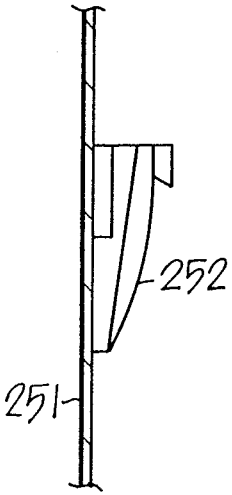

INCREASED TORQUE BRIDGE FOR GUITARS

This application is a continuation-in-part of Ser. No. 039,941, filed Apr. 20, 1987, of the same title.

FIELD OF THE INVENTION

This invention relates to tension bridge for guitars and more particularly, to tension bridges to increase volume, power and sustaining quality of the guitar.

PRIOR ART

Prior art is shown in the following patents: 621,700 4,311,078 4,320,685 4,464,970 4,436,015 4,497,236 4,506,585 4,538,498.

None of the above patents discloses the improvement of the invention which increases the volume, power and sustaining quality of the music.

BACKGROUND OF THE INVENTION

It is known to those skilled in the guitar art that there are two types of string tuninhg. One type of tuning is referred to as pitch, or fine tuning, which is accomplished by increasing or decreasing the tension on a given string by means of tuning keys or the like, thereby raising or lowering, respectively, the pitch of the string. The other type of string tuning is referred to as harmonic or string length tuning, which is accomplished by altering the distance between the points at which a given string contacts the and nut elements of the instrument. The wedge pre-tensions the sound board tension and separates push and pull counter-forces. The definition of torque is string tension X effective height between the bridge and front faced assembly.

The standard acoustical guitar has not changed dramatically for perhaps a century. Three of the main ingredients that make one guitar superior over another are volume, sustain and balance.

There are two main types of acoustical guitars, It is known to those skilled in the guitar art that there are two types of string tuning. One type of tuning is referred to as pitch or fine tuning, which is accomplished by increasing or decreasing the tension in a given string by means of tuning pegs or the like, thereby raising or lowering, respectively, the pitch of the string. The other type of string tuning is referred to as harmonic or string length tuning, which is accomplished by altering the distance between the points at which a given string contacts the bridge and nut elements of the instrument. classical or nylon string and steel string, steel string having two main types, flat top and arched top.

This bridge invention may be used to improve all of these guitars. To help in understanding this invention, knowledge of the background of the classical guitar is helpful.

The classical guitar reached one of its evolutionary plateaus with the designs of the designer Antonio Torres.

Torres established the string length at 25 9/16". That is to say the point of contact from the edge of the nut to the tip of the bridge. The 25 9/16" length has proven over the years to be the most musical balanced, and mellow of all string lengths.

Many prominent designers in their demand to come up with a louder guitar have compromised the 25 9/16" length in order to have a louder guitar. To understand this more completely, see the following formula:

Longer string length=more tension on bridge=more volume.

The main purpose of the bridge of the invention is to allow the string length to remain at 25 9/16" yet increase volume levels equal to or surpassing that of a guitar with a longer string length. A longer string length may still be used with the tension bridge.

THE INVENTION

Applicant has found that by raising the strings above the sound board considerably more than in conventional guitars, he is able to obtain the additional volume, power and sustaining qualities. The invention comprises a new bridge piece having a first base member mounted on the sounding board of the body. A second enlarged saddle member is on the first member. The first member has a transverse notch on its lower surface and a third wedge member is mounted in said notch.

Using the new bridge it is possible to adjust the vertical height and horizontal length of the string to increase the string torque thereby increasing the energy. This increases the volume. At the same time it permits the ability to adjust and fine tune the quality of the sound produced.

OBJECTS OF THE INVENTION

A principal object of the invention is to provide new and improved tension bridges for guitars.

Another object of the invention is to provide new and improved tension bridges for guitars which provides additional volume, power and sutaining quality.

Another object of the invention is to provide new and improved stringed musical instruments on the type having a hollow body over which are stretched substantially parallel strings, each string being stretched between a tuning key and a bridge piece, the bridge piece comprising: a first base member mounted on the top board of the body, a second saddle member mounted on the first member, the first member having a transverse notch on its lower forward surface and a third wedge member mounted in said notch, thereby producing means for string length fine tuning.

BRIEF DESCRIPTION OF THE DRAWINGS

The aforementioned objects, of the invention will become apparent from the following specification and drawings of which:

FIG. 5, is a perspective view of another embodiment of the bridge utilizing a single piece for each saddle;

FIG. 7 is a chart showing variations in the second functional point which is used in controlling the compensation for string length fine tuning;

FIGS. 8A–8I show various arrangements for upper and lower sections of the saddle;

FIG. 9 shows the upper and lower sections of the saddle put together;

FIG. 10 is a bridge arrangement which separates the push and pull forces;

FIG. 11 is a view of a bridge showing the arrangement in accordance with the present invention;

FIG. 12 is a bridge showing a movable saddle for use in controlling the second functional height with the first functional height being fixed on the lower portion of the saddle;

FIG. 13 shows an arrangement using a screw to adjust the second functional height with the first functional height being fixed on the lower portion of the saddle;

FIGS. 22–25 are detail views of modifications.

DESCRIPTION OF A PREFERRED EMBODIMENT

Figure 1:
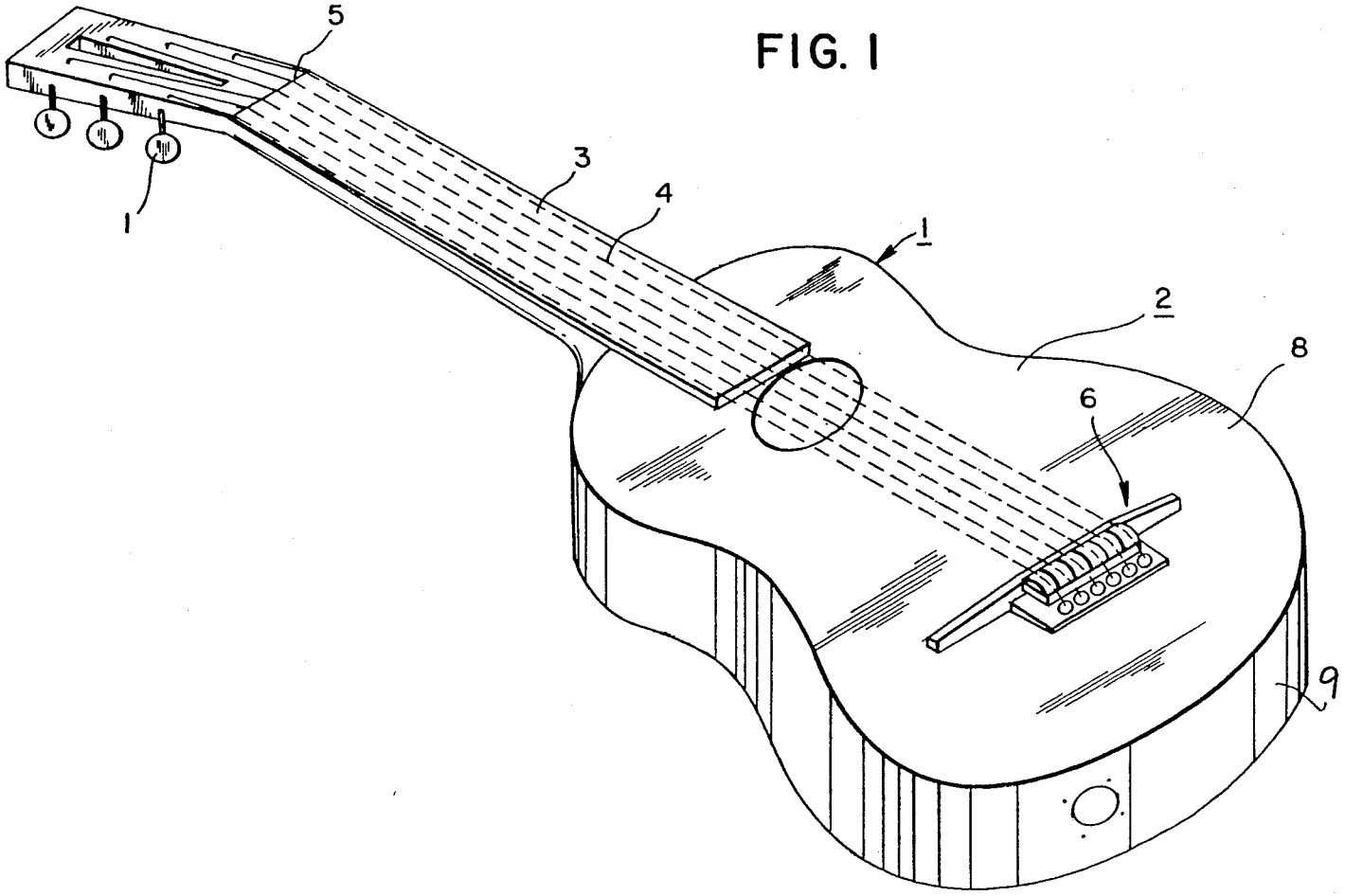
FIG. 1 is a perspective view of an embodiment of the invention.

Referring now to the figures, FIG. 1 shows a guitar 1, including a body portion 2 from which extends a fret board 3 on which are positioned a plurality of strings 4 extending between a nut 5 and a bridge, shown generally at 6. The strings are adjusted by means of tuning keys 7 placed on the head of the guitar. The body 2 includes the sound board cover 8 over a resonating box 9 having acoustical properties.

Figure 2:
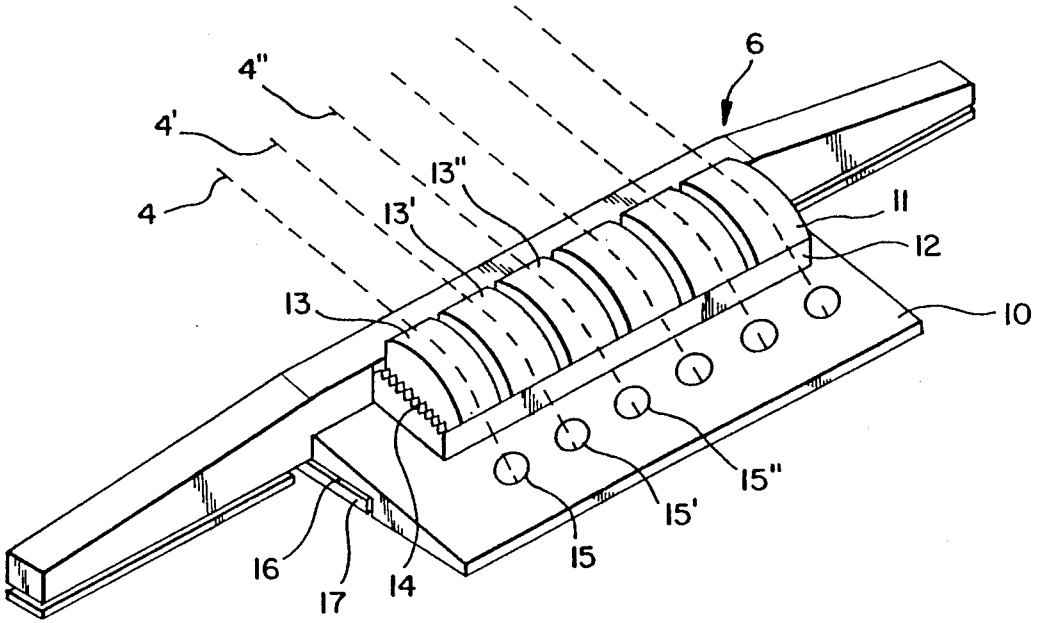
FIG. 2 is an enlarged perspective view of the bridge.

A perspective view of one embodiment of the bridge 6 is shown in more detail in FIG. 2. The bridge 6 comprises a base portion 10 on which are positioned a plurality of saddles 11. The saddles are shown in this embodiment to include a single lower saddle portion 12 with a plurality of individual upper saddle portions 13, 13', 13'', etc. A mating grooved arrangement 14 is provided between the upper and lower saddle portions. Each of the individual upper saddle portions 13, 13' 13'' accommodates a corresponding string 4, 4', 4'', etc. The strings pass over the upper saddle portions 13, 13', 13'', etc. and are led underneath the sound board and anchored below the sound board by passing through openings 15, 15', 15'', etc.

The base member 10 includes a notch 16 into which is inserted a wedge 17 for the purpose of adjusting the rigidity of the base 10. This also separates the push-pull forces, as will be hereinafter shown.

Figure 3A:
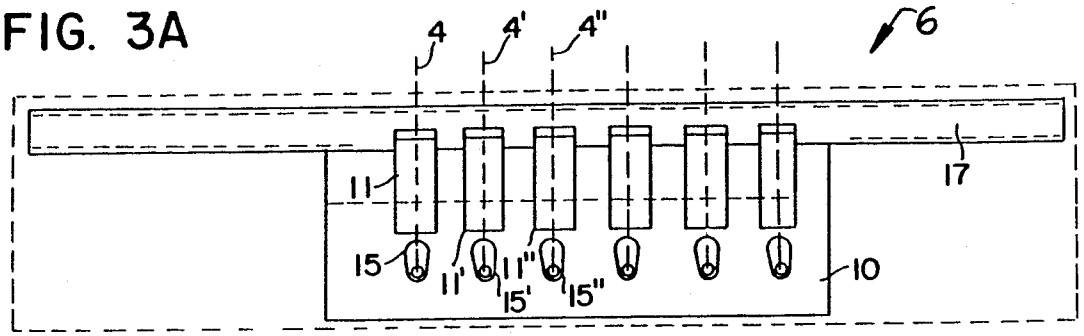
FIGS. 3A, 3B and 3C show respectively top views, a sectional elevational view, and a sectional side view of an embodiment of the bridge shown in FIG. 2.
Figure 3B:
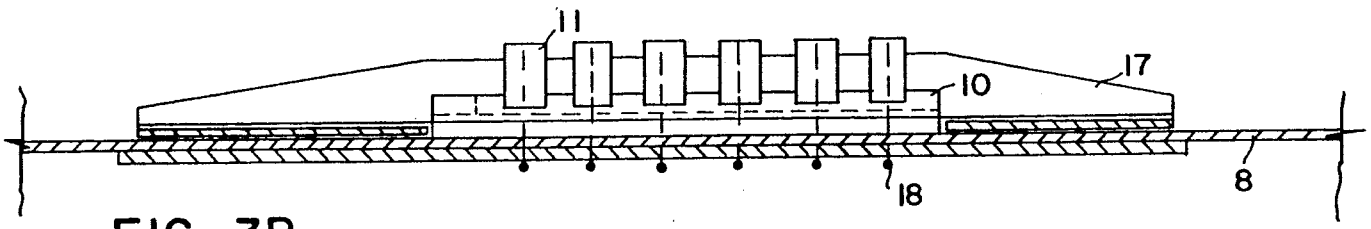
Figure 3C:
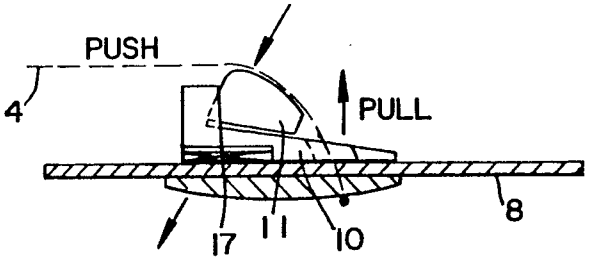

FIGS. 3A, 3B, and 3C respectively show a top view, a partial sectional view, and a sectional side view through the bridge 6 shown in FIG. 2. In these figures, there is also noted the interconnection of the base member and the wedge on top of the sound board 8 and the strings secured thereunder at 18. FIG. 3C also shows the push and pull forces exerted on the wire 4 which in turn exerts the forces on the saddle and base of the bridge 6.

It should be noted, that while in FIG. 2 a single lower saddle portion 12 has been shown, in the embodiment of FIGS. 3A–3C, both the upper and lower saddle portions have been made into a unitary member, as will hereinafter be described, whereby a separate saddle is provided for each string.

Figure 4A:
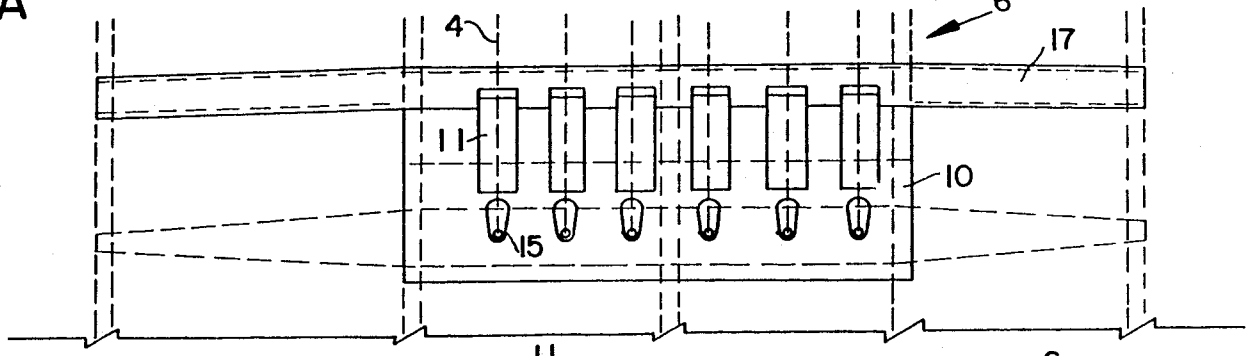
FIGS. 4A, 4B and 4C show views similar to that shown in FIGS. 3A–3C but this time including the undersurface bracing for the bridge.
Figure 4B:
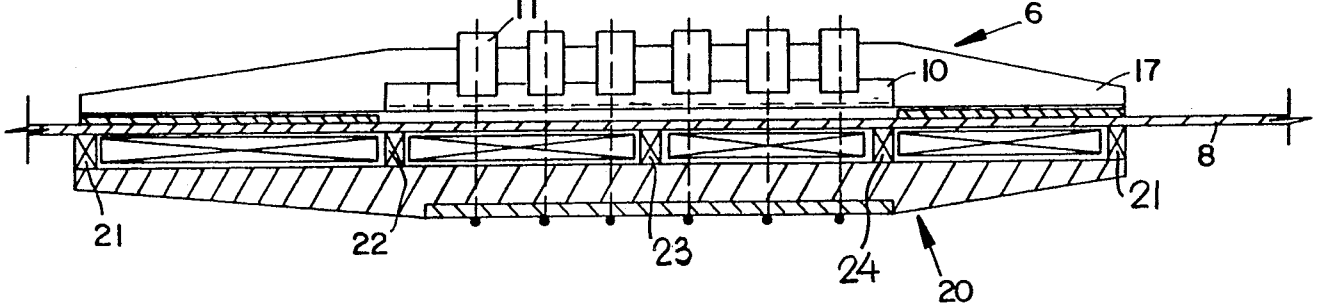
Figure 4C:
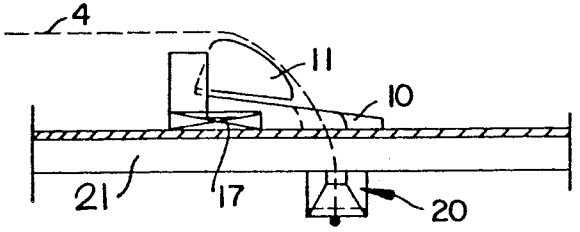

Referring now to FIGS. 4A, 4B and 4C, there is respectively shown the top view, a cross sectional view, and a cross sectional side view of a similar bridge arrangement this time including an undersurface cross bar brace, shown generally at 20. The brace includes the solid members 21, 22, 23 and 24 which serve to reinforce the bridge member shown generally at 6. The undersurface cross bar is mounted under the sound board 8 upon which is mounted the bridge 6. This is an example of fan bracing.

Referring now to FIG. 5 there is again shown a bridge 25 including a base portion 26 with a plurality of individual saddle portions 27, 27', 27'', etc. The saddle portions each include only a single structure rather than the upper and lower portions heretofore described. The strings 4, 4', 4'' again pass through the openings 28, 28', 28'' provided, and pass into the body portion below the sound board 29. The wedge 30 sits within the notch 31 provided in the base portion. The individual saddle members 27, 27', 27'', etc. are set against the base at an angle of 90° which converts the horizontal pressure of the strings into vertical pressure as it passes over the surface of the saddle and down through the openings 28, 28', 28''.

Figures 6F, 6G, 6H, 6I:
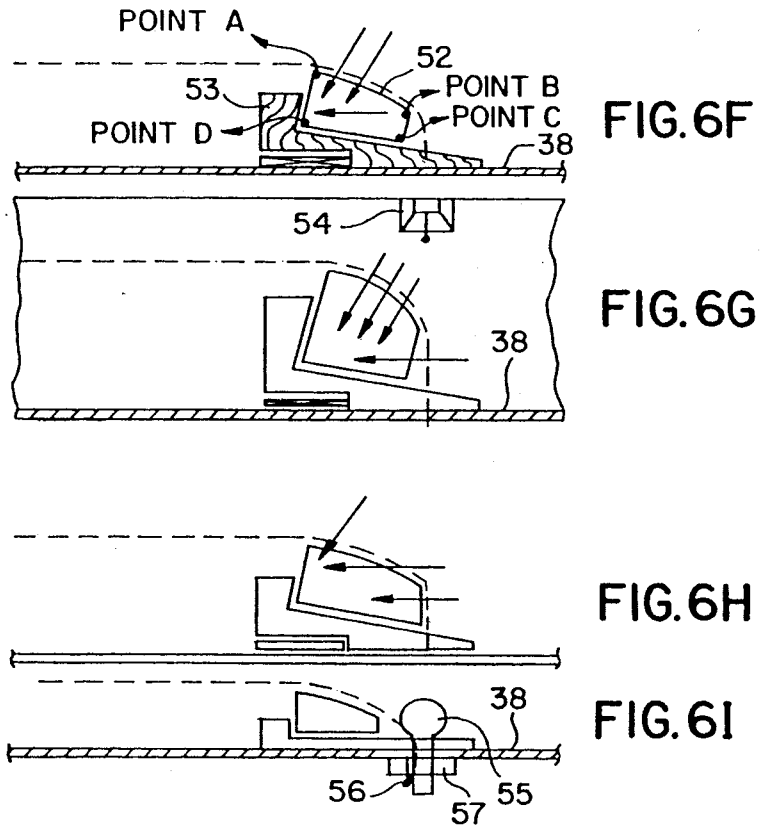
FIGS. 6A–6I show various views of bridges and saddles useful in explaining the benefits of the present invention.
Figures 6A, 6B, 6C, 6D, 6E:
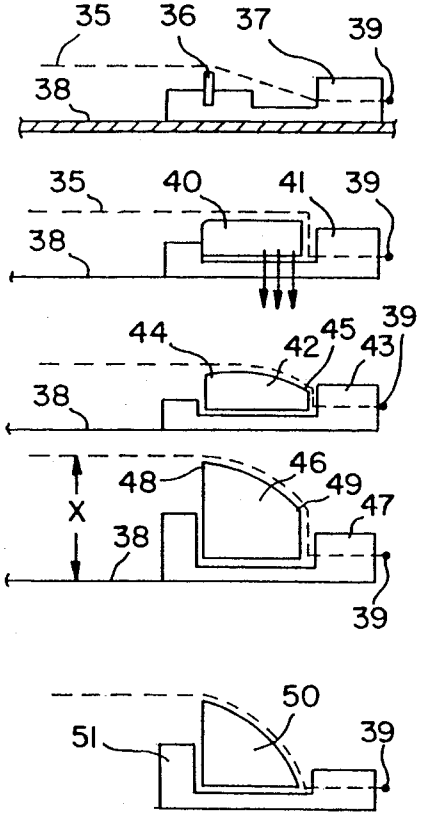

Referring now to FIGS. 6A–6I there will be explained the theory behind the design of the improved bridge arrangement for longitudinally extending and vertically adjusting the height in order to improve the sound quality and provide fine tuning. Referring to FIG. 6A, there is shown an example of a standard guitar bridge wherein the wire 35 extends over the saddle point 36 on the bridge 37 positioned on the sound board 38 and connected at the point 39.

FIG. 6B shows an example of longitudinally extending the saddle 40 in the bridge 41 so that the wire 35 extends beyond the point of the standard bridge guitar shown in FIG. 6A. In doing so, there is provided an increased force against the sound board 38.

FIG. 6C shows an example of an extended saddle but this time providing two functional heights. Specifically, the saddle 42 on the bridge 43 now includes an upper point 44 and a lower point 45 along an upper curved surface of the saddle.

FIG. 6D provides an example of not only longitudinally extending the saddle but likewise vertically extending the saddle. Both of the functional heights are increased. Specifically, the saddle 46 in the base 47 now extends the string upwardly at the point 48 by a distance "X". Such distance between the string and the sound board is increased by about 7/8" to 1". At the same time, there is provided the lower point 49, as will hereinafter be explained.

FIG. 6E shows a similar example to that of FIG. 6D. However, in this case the saddle 50 in the base 51 indicates that it is possible to provide a curve in its shape completely down to the point of attachment 39 and still providing the function as a counterforce against the string.

FIG. 6F indicates the various points on the saddle 52 which is positioned on the base 53. Specifically, it is noted that point "B", identified as the first functional height, is closest to the string anchor, and is at a lower point than point A, referred to as the second functional height. The first functional height, point "B" is movable to affect string tension and sound quality. It is noted, that it is placed away from point C and this aids in avoiding string buzz. The position of point "B" adjusts the vertical positioning of the saddle length.

Point A, the second functional height, is movable to compensate for string length and fine tuning. this likewise adjusts the vertical height. Point "D" is the point of engagement with the base 53.

It should also be noted, that in FIG. 6F, instead of providing for a horizontal interconnection to the guitar sound board, the string is pulled down through the sound board 38 to connect to the anchor 54 beneath the sound board. Such anchor can be of the type heretofore shown in FIGS. 4A–4C. By interconnecting the string beneath the sound board, there is provided greater isolation between the push and pull forces and provides greater exertion of force on the sound board.

FIG. 6G shows an arrangement similar to 6F. However, the distance between point "D" and point "A", is increased, thereby increasing the vertical height above the sound board 38.

FIG. 6H provides a greater distance between point "D" and point "C" in order to provide more horizontal pressure. It should be noted, that the angle of the base serves to convert the horizontal pressure into downward vertical pressure.

FIG. 6I shows a further arrangement whereby an additional pin, 55 is used in conjunction with a vertical interconnection 56 beneath the sound board 38. The pin secures the string to the undersurface cross member brace 57.

As has been explained, the particular shape of the top surface of the saddle, and especially as it is positioned on the base, will serve to adjust the various heights in order to property adjust the sound quality, volume, and tuning. FIGS. 7A–7F show a table in which there are shown various shapes of the saddle surfaces that can be used in order to provide the various second functional heights. In each case, the top, front and side view of the saddle is shown.

Since the saddle piece can be provided in two parts, there is shown in FIG. 8A a lower saddle portion 60 which can be combined with any one of the various upper saddle portions 61 shown in FIGS. 8B–H. A combination of such upper and lower saddle portons 60, 61 is shown in FIG. 9. Each of these saddle portions would correspondingly provide for different string length, string height, and thereby provide for the variations in tuning, quality, and volume.

Using the various principles heretofore discussed, there will now be described various base members and saddles that can be utilized in order to incorporate these principles. In FIG. 10, there is described a prior art bridge called the Direct Coupled Bridge manufactured by St. Louis Music Corp. There is shown a base member 65, which is separated completely from the other members. The base member is glued on to the sound board 66. The string 67 passes over the saddle 68 and then is connected to the anchor 69. A pin 70 interconnects to the undersurface support member 71. In this example, the push-pull mechanism is separated. FIG. 11 is a modified example of that shown in FIG. 10 and in this case, using the principles of the invention. As shown the base member 72 accepts an extended saddle 73 where the heights can be made such as to control the sound quality.

Referring now to FIG. 12, there is shown a saddle 75 which serves as the lower portion. The first functional height which is closest to the anchor is directly incorporated into this lower saddle portion. There is additionally provided an individual movable upper saddle piece 76 which can be moved along the lower saddle portion 75 by means of the mating grooved arrangement 77. This movable upper saddle piece 76 provides the second functional height. It should be appreciated, that either a single lower saddle portion 75 can be provided for all six strings or separate lower saddle portion 75 provided for each string. This was previously shown with respect to FIGS. 2 and 3.

FIG. 13 shows an example which again includes a lower saddle portion 78. Again the first functional height is provided at the lower saddle portion indicated at 79. In this case, the second functional height is provided by an individual saddle piece 80 which is interconnected and adjusted by means of a screw mechanism 81. Adjusting of the screw moves the individual saddle piece 80 into its proper position thereby providing the second functional height.

In addition to the embodiment shown at FIG. 13, other embodiments can be construed whereby the base members are designed to incorporate an adjustable screw which pushes the saddle piece off the front wall in order to adjust the first and second functional heights. The first is the height closest to the string anchor. As previously indicated, adjustment of such height serves to affect the string tension and sound quality thereby adjusting the sustain and volume of the string. The second functional height serves as a means for fine tuning.

Figure 14A:
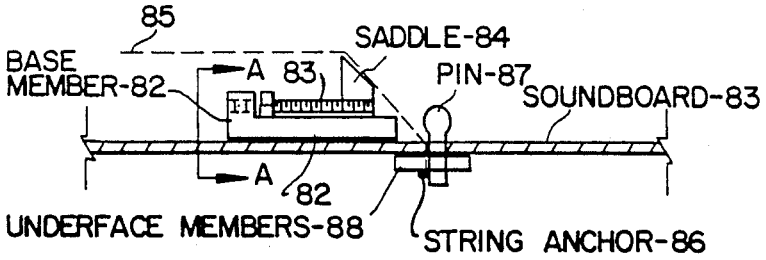
FIGS. 14A–14C show the use of a screw for adjusting a saddle for controlling the first functional height.

Referring to FIGS. 14A, B and C there are respectively shown a side view of a base member incorporating an adjustable saddle, a sectional view taken along line A—A of FIG. 14A, and in 14C an enlarged view of the adjustment nut. In FIG. 14A, the base 82 is shown mounted on the sound board 83. On the base is provided an adjustment screw 83 on which is positioned the saddle 84. The string 85 passes over the edge of the saddle and is connected to the string anchor 86 by means of the pin 87 are connected to the underface securing members 88.

Figure 14B:
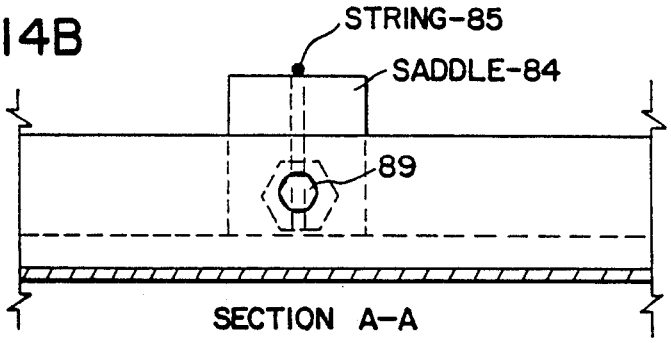
Figure 14C:
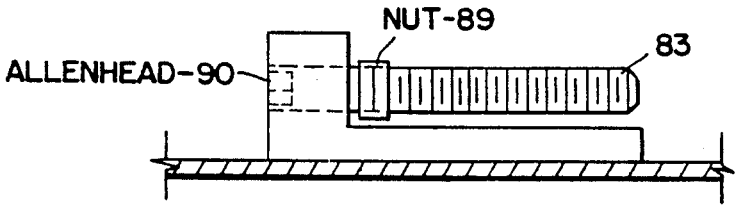

As best seen in FIGS. 14B and 14C, the screw 83 contains a nut threaded to accept the screw 89. The nut is forced against the front wall of the base member to retain it in place. An Allen head socket 90 is provided to adjust the saddle position along the base thereby moving the saddle to a desired position to achieve a first functional height needed to produce the desired effect of sound quality on the string.

Figure 15A:
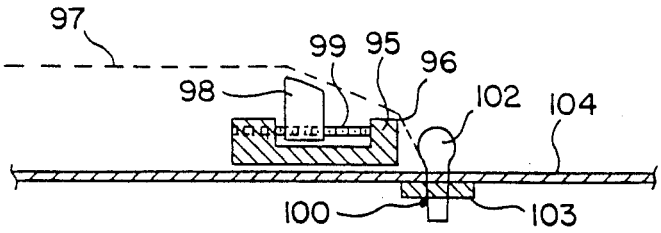
FIGS. 15A–15C show arrangements for controlling the second functional height with the first functional height being fixed on the base member.
Figure 15B:
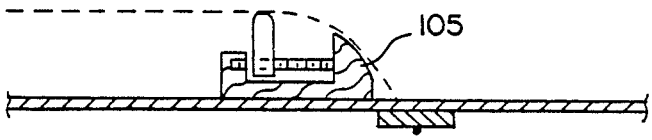

Variations on the use of the screw are shown in FIGS. 15A and 15B. In this case, the first functional height is already provided on the base member and the screw is used to adjust a saddle to control the second functional height. As shown in FIG. 15A, the base member 95 includes the first functional height at its tip 96 as the string 97 passes over the saddle 98 and then on to the first functional height 96. The saddle 98 provides the second functional height in order to provide control of the string length fine tuning. Such is adjusted by means of the screw movement 99. The string is held anchored at 100 by means of the pin 102 and the anchor 103 under the sound board 104. The screw may be attached to the rear wall or front wall of the base member.

FIG. 15B is a similar view. However, in this case the front edge of the base is arcuately shaped at 105.

Figure 15C:
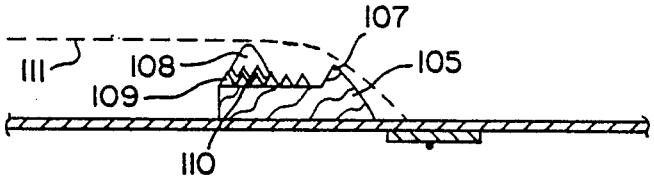

FIG. 15C shows a similar arrangement without the use of the screw member. Specifically, in this case the base 106 contains the first functional height at its point 107. The second functional height, to control the fine tuning, is provided by a upper saddle portion 108 which is interconnected to a lower saddle portion 109 by a series of grooves 110. The upper saddle 108 can be moved along the grooves to adjust the second functional height for the string 111.

Figure 16A:
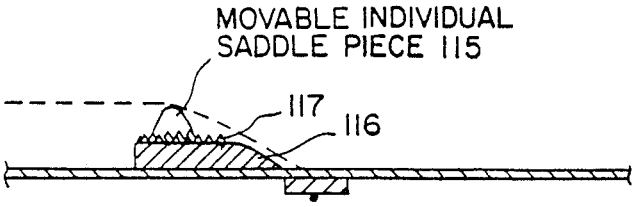
FIGS. 16A–16F show variations in controlling the second functional height using a movable saddle.
Figure 16B:
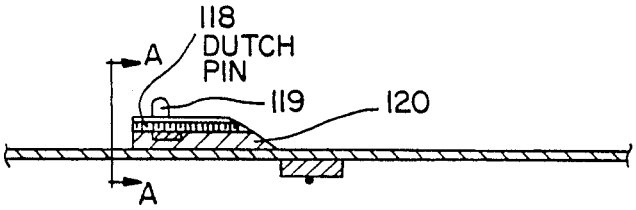
Figure 16C:
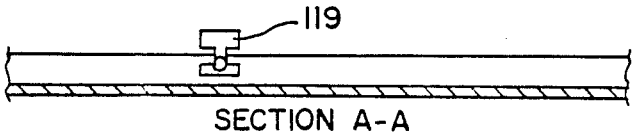
Figure 16D:
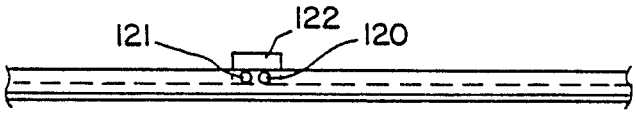

Referring now to FIGS. 16A–F there is provided a series of examples showing ways for adjusting the string length fine tuning on to the base members. In FIG. 16A there is shown the use of the movable individual saddle piece 115 which is separated from a base 116 by means of the mating grooved connection 117. In FIG. 16B, there is shown a Dutch pin 118 which controls the movement of a saddle portion 119 on to the base 120. The particular shape of the saddle 119 is substantially "T" shaped, as shown in FIG. 16C which is a view taken along line A—A of FIG. 16B. Such "T" shape prevents shake or wobble of the saddle. An alternate approach would be to use two screws, as shown in FIG. 16D with the screws 120, 121 interconnected to the saddle 122.

Figure 16E:
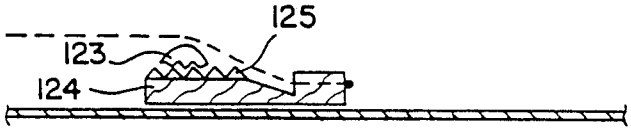
Figure 16F:
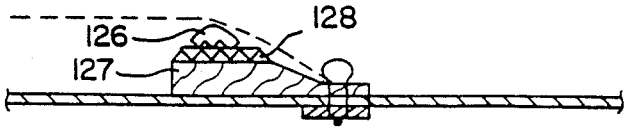

FIG. 16E shows how the saddle arrangement 123 can be incorporated onto a standard classical type of bridge 124 by means of the addition of the grooved piece 125 glued onto the base 124. FIG. 16F shows a similar saddle 126 which can be placed onto a standard base 127 which is of a type incorporated onto a "steel string type of bridge". Again, the addition of the grooved portion 128 is added onto the base.

Figure 17:
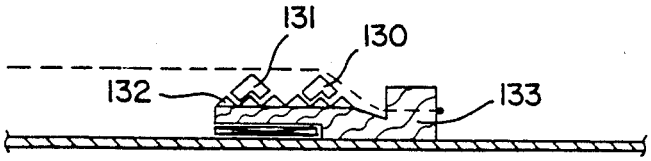
FIG. 17 shows an arrangement for having movable saddles for controlling both the first and second functional heights.

FIG. 17 shows a situation where two individual saddles are provided each one used to provide a separate height. Saddle 130 provides the control of the first functional height and saddle 131 provides control of the second functional height. Both of these are connected by means of grooves 132 onto the base 133.

Figure 18:
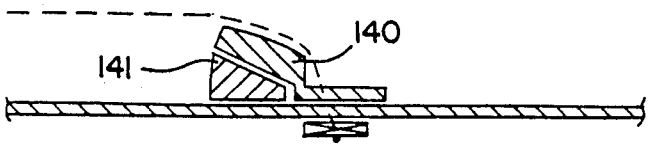
FIG. 18 shows a unitary arrangement of construction for both the base and the saddle.

As shown in FIG. 18 various members may be utilized for forming the base and saddle. For example, it may be composed of graphite or synthetic. For best results, synthetic material should be light in weight yet dense. This provides the maximum ability to transmute string vibrational energy to the sound board. A synthetic or wood or graphite can be utilized. In such situation, it is possible to incorporate both the base and the saddle in one piece as shown at 140. Likewise, a synthetic wedge 141 would be utilized. Using synthetic material or wood, both the saddle and the base members may be synthesized into one piece.

Figure 19:
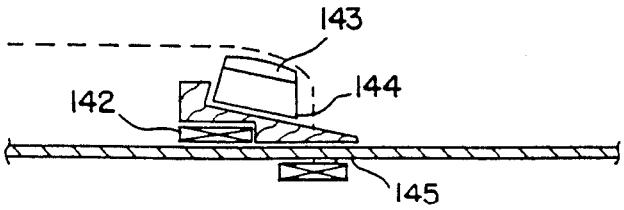
FIG. 19 shows an arrangement for including a transducer or other sound element as part of the bridge arrangement.

If a transducer element or M.I.D.I. (musical instrument digital interface) is to be incorporated into the bridge, it can be placed in various locations, such as shown in FIG. 19. By way of example it can be placed under the wedge 142. It can likewise be placed under an individual string saddle 143 or under the entire saddle 144. Likewise, it can be placed under the cross brace 145. Other locations include between the wedge and the base member, under the wedge between the wedge and the sound board, or between the cross brace and the under surface.

Figure 20A:
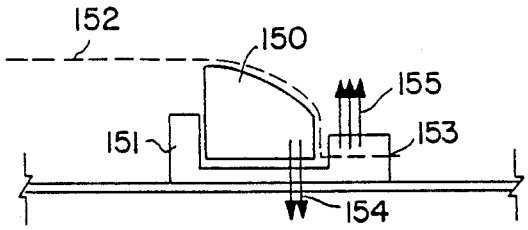
FIGS. 20A–20E show the use of the wedge in separating the push and pull forces.

Heretofore, the use of the base and the saddle has been described in order to provide the first and second functional height in order to achieve the proper string tension and string length fine tuning. As was mentioned, the use of the wedge also provides improved separation between the push-pull forces. This can best be explained with reference to FIGS. 20A–20E. FIG. 20A shows an example of a functional bridge design wherein the saddle 150 is placed on the bridge 151 with the string 152 passing over it and secured in a horizontal manner at 153. In this case, there is the downward push forces 154 and the upward pull forces 155 both on the same member.

Figure 20B:
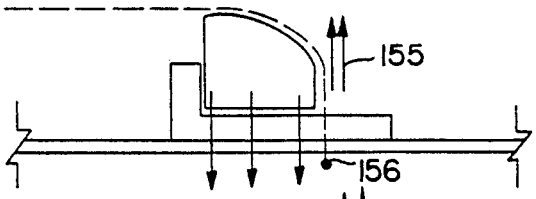

As shown in FIG. 20B, by placing the string anchor under the sound board, at 156, the upward pull force 155 becomes greater. However, there is still no isolation between the pull and push forces.

Figure 20C:
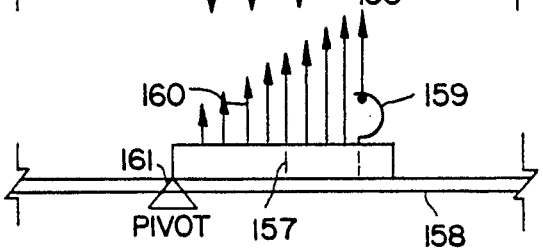

As shown in FIG. 20C, if a plank of wood 157 were glued onto a surface 158, and then pulled upward on one end by a hook 159, all the upward forces 160 would be apparent along the entire surface. The surface would be pivoted about the pivot point 161. More force is obviously directed on the side furthest away from the pivot. The reverse is realized when the pull is in the opposite direction. However, both the push and the pull would be on the same member.

Figure 20D:
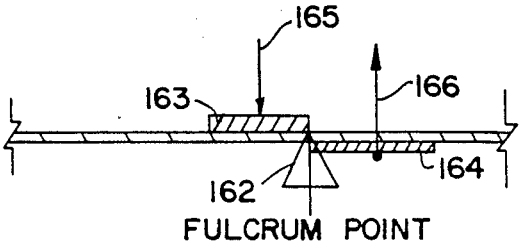

As shown in FIG. 20D if a fulcrum point 162 is placed between two opposing members 163 and 164, then the push force 165 would be down on one point and the pull force 166 would be up on the other member.

Figure 20E:
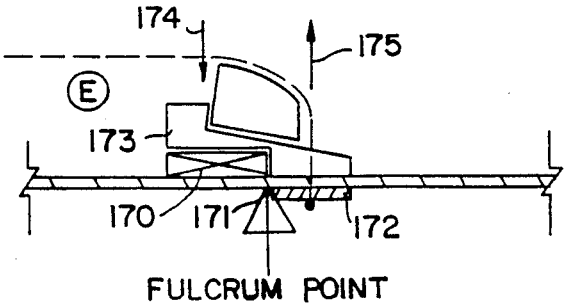

This is effectively achieved as shown in FIG. 20E where the wedge 170 is used. The tip of the wedge serves as the fulcrum point 171 between the sound board anchor 172 and the base 173. In this way, the push 174 and the pull 175 are isolated and the fulcrum point separates the opposing forces.

Figures 21A, 21B, 21C:
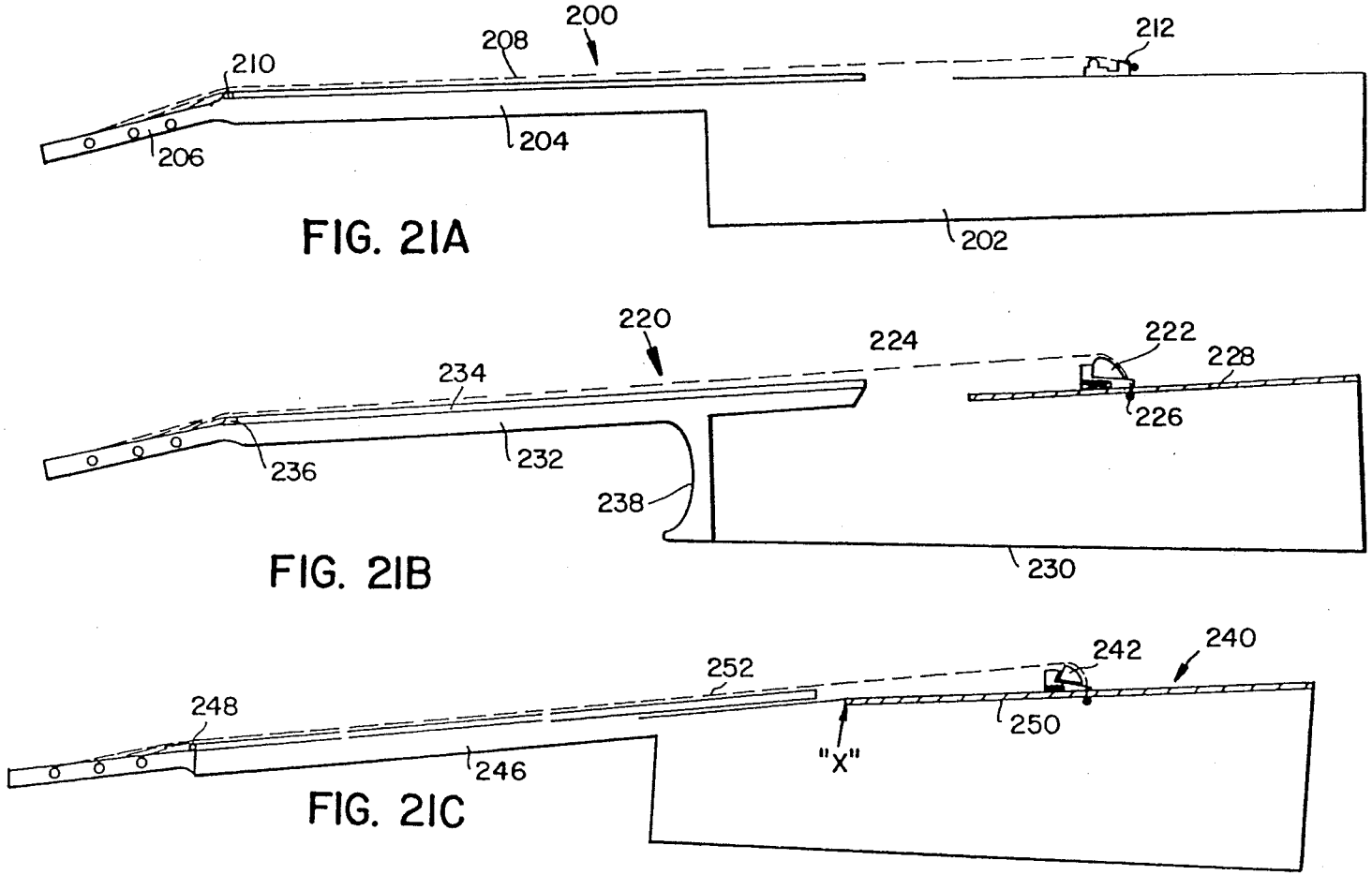
FIGS. 21A–21C show the use of the bridge in a new guitar which further increases string torque.

Referring now to FIGS. 21A–21C there is shown the new bridge in connection with a varied guitar which further increases the torque. In FIG. 21A, there is shown a standard guitar 200 having a body portion 202 connected to the neck 204 from which terminates the head 206. The wire 208 is stretched between the nut 210 and the bridge 212. It is noted, that from the nut 210 and forward the head is bent down whereby the nut is lower than the tip of the bridge saddle.

In FIG. 21B, this concept is applied to the guitar 220 as shown. It is first noted that there is provided the new and improved bridge 222 as heretofore described with the string 224 anchored at the point 226 below the sound board 228 of the body portion 230. The neck 232 is modified by having an angled fret board 234. In this way, the nut portion 236 is even further lowered as compared to the bridge 222. An additional improvement is shown by having the inside of the neck 238 shaved to provide an arcuate surface. It should be noted, that in this case, the distance between the string and the top of the fret board remains the same as that of a standard guitar.

In FIG. 21C there is shown a further guitar 240 again utilizing the new bridge arrangement 242 as heretofore described. In this embodiment, again the neck 246 is lowered by angling it downward so that the nut 248 is lower tha the tip of the bridge. Additionally, the sound board 250 is angled at the point X in order to produce optimum string torque of the string 252. This adds additional push forces against sound board 250. In each of these new embodiments the new bridge arrangement hweretofore described is being utilized.

Accordingly, it has been seen that in the present invention there is provided a bridge for guitars whereby the bridge includes a base, a saddle and a wedge. By means of the shape of the saddle and/or the base, it is possible to adjust the functional height closest to the string anchor in order to effect string tension and sound quality to provide the proper volume and sustain desired. The height at a point remote from the anchor can also be adjusted to compensate for string length fine tuning. These can either be made continuously adjustable or can be prefixed to a desired value. However, the selection can be made in order to achieve the desired sound effect.

FIGS. 22*a*, 22*b*, show a base member 251, with four cross-grain support braces, 252–255.

Figure 23A:
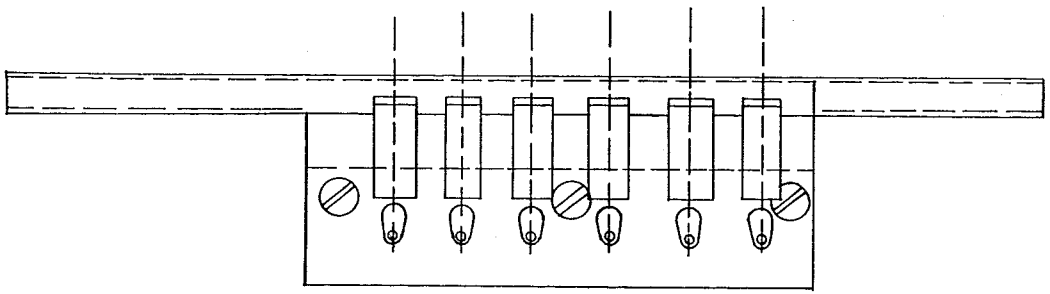
Figure 23:
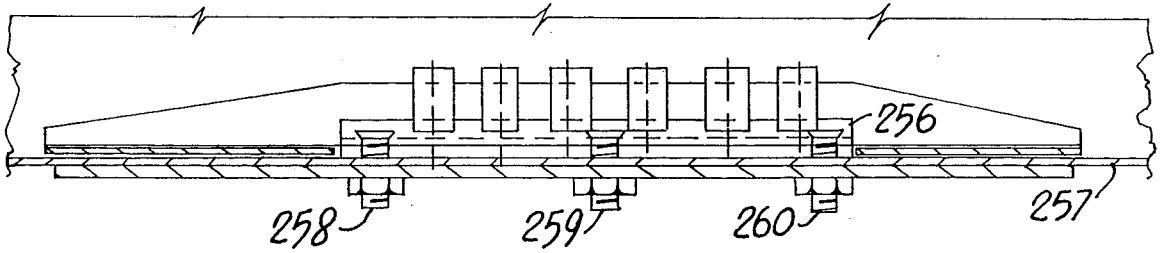
Figure 23B:
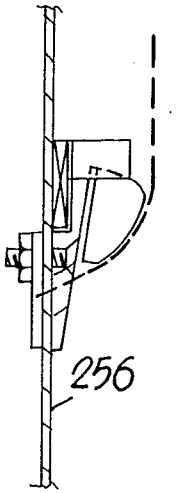

FIGS. 23, 23*a*, and 23*b*, show a base member 256, which is screwed to the soundboard 257, by means of screws 258, 259 and 260.

Figure 24:
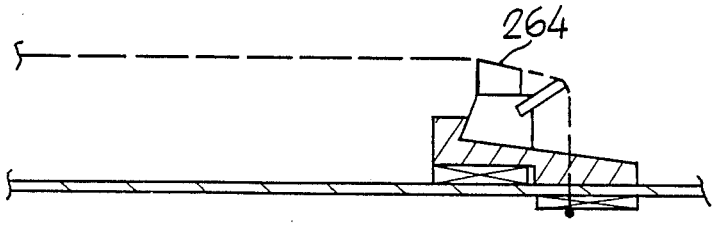
Figure 25:
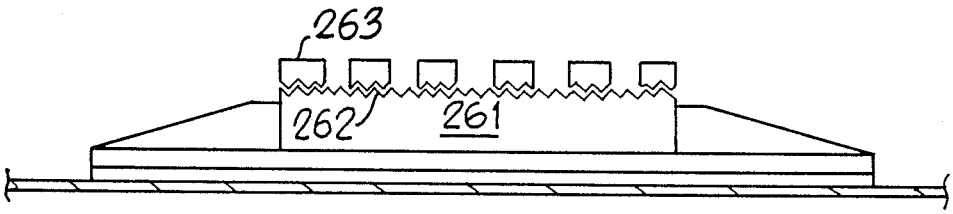

FIGS. 24, 25, show a base saddle 261, having grooves 262, which mount second saddles 263, etc., to control position of the first functional height, and a third movable saddle 264, in the second movable saddle to control position of the second functional height.

It is claimed:

1. In a stringed musical instrument having a resonating box, a sound board on the resonating box a plurality of strings extending longitudinally over the sound board, a bridge on which the strings pass in stretched condition, and tuning means remote from the bridge for varying the tension in the strings, an improvement according to which said bridge comprises:

a base on the sound board, said base having an upper surface;

a saddle on the upper surface of the base;

anchor means for attaching the strings to the sound board in spaced relation from said saddle;

said saddle having an upper surface elevated above said base and positioned so that the tensioned strings pass thereon and apply force to the saddle to press the saddle against the base and to urge the saddle longitudinally towards the tuning means, said base having an upstanding wall, said saddle having a front surface which abuts against said upstanding wall under the tension in the strings; said front surface of said saddle having a lower point of engagement with the base at the intersection of the upstanding wall and upper surface of said base;

said upper surface of said saddle and said base being configured to provide a guide path for said strings so that each string has first and second longitudinally spaced points of support on the bridge which have respective functional heights above the sound board, the first point of support being closer to the tuning means, said points of support being positioned so that each string undergoes a change of angle at each of said points of support to apply forces to the saddle directed towards said point of engagement of the front surface of the saddle with the intersection of the front wall and the upper surface of the base which forces, in turn, are applied to the sound board and the resonating box therebelow, means for longitudinally adjusting the position of said first point of support with respect to said second point of support to effect fine tuning of the string, said anchor means being at an intermediate location on the sound board for anchoring the string to the sound board above the resonating box.

2. The musical instrument as claimed in claim 1 wherein said bridge has a front wall with a transverse notch in said wall forming a space between the bridge and the soundboard and a wedge inserted in said space.

3. In a stringed musical instrument having a resonating box, a sound board on the resonating box, a plurality of strings extending longitudinally over the sound board, a bridge on which the strings pass in stretched condition, and tuning means remote from the bridge for varying the tension in the strings, an improvement according to which said bridge comprises:

a base on the sound board, said base having an upper surface;

a saddle on the upper surface of the base;

anchor means for attaching the strings to the sound board in spaced relation from said saddle;

said saddle having an upper surface elevated above said base and positioned so that the tensioned strings pass thereon and apply force to the saddle to press the saddle against the base and to urge the saddle longitudinally towards the tuning means, said base having an upstanding wall, said saddle having a front surface which abuts against said upstanding wall under the tension in the strings; said front surface of said saddle having a lower point of engagement with the base at the intersection of the upstanding wall and upper surface of said base;

said upper surface of said saddle and said base being configured to provide a guide path for said strings so that each string has two longitudinally spaced points of support on the bridge which have respective functional heights above the sound board, said anchor means comprising a brace secured to said sound board on the underside thereof, said sound board being provided with apertures through which the strings pass for attachment to said brace, said brace comprising a plurality of longitudinal support members secured to the underside of the sound board and disposed in transversely spaced relation below the bridge, and a cross bar extending below and transversely of the support members, said strings being secured to said cross bar.

4. The musical instrument as claimed in claim 3 wherein said longitudinal members are substantially parallel to one another.

5. In a stringed musical instrument having a resonating box, a sound board on the resonating box, a plurality of strings extending longitudinally over the sound board, a bridge on which the strings pass in stretched condition, and tuning means remote from the bridge for varying the tension in the strings, an improvement according to which said bridge comprises:

a base on the sound board, said base having an upper surface;

a saddle on the upper surface of the base;

anchor means for attaching the strings to the sound board in spaced relation from said saddle;

said saddle having an upper surface elevated above said base and positioned so that the tensioned strings pass thereon and apply force to the saddle to press the saddle against the base and to urge the saddle longitudinally towards the tuning means, said base having an upstanding wall, said saddle having a front surface which abuts against said upstanding wall under the tension in the strings; said front surface of said saddle having a lower point of engagement with the base at the intersection of the upstanding wall and the upper surface of said base;

said upper surface of said saddle and said base being configured to provide a guide path for said strings so that each string has two longitudinally spaced points of support on the bridge which have respective functional heights above the sound board, said points of support being positioned so that each string undergoes a change of angle at each of said points of support to apply forces to the saddle directed towards said point of engagement of the front surface of the saddle with the intersection of the front wall and the upper surface of the base which forces, in turn, are applied to the sound board and the resonating box therebelow, said string undergoing change of angle at the rear point of support such that the strings pass from said rear point of support substantially perpendicularly to the sound board, said anchor means being at an interior location on the sound board for anchoring the string to the sound board above the resonating box substantially perpendicularly to said sound board.

6. The musical instrument as claimed in claim 5 comprising means for adjusting the relative positions of said two points of support.

7. The musical instrument as claimed in claim 6 wherein said means for adjusting the relative positions of said two points of support comprises means for adjusting relative height positions of said two points.

8. The musical instrument as claimed in claim 6 wherein said means for adjusting the relative positions of said two points of support comprises first and second members each providing a respective one of said two points of support and grooved engaging surfaces on said first and second members enabling said members to be adjusted in relative longitudinal position and to be fixed in the adjusted longitudinal position.

9. The musical instrument as claimed in claim 6 wherein said anchor means comprises a brace secured to said sound board on the underside thereof, said sound board being provided with apertures through which the strings pass for attachment to said brace.

10. The musical instrument as claimed in claim 9 wherein said brace comprises a plurality of longitudinal support members secured to the underside of the sound board and disposed in transversely spaced relation below the bridge, and a cross bar extending below and transversely of the support members, said cross bar being secured to the support members, said strings being secured to said cross bar.

11. The musical instrument as claimed in claim 5 wherein said base has a lower front surface with a transverse notch therein, and a wedge member is wedged in said notch between said base and said sound board.

12. The musical instrument as claimed in claim 5 comprising a plurality of transversely spaced longitudinal brace members on said base extending rearwardly from said upstanding wall.

13. The musical instrument as claimed in claim 5 comprising means for transversely adjusting the points of support of one string with respect to the other strings.

14. The musical instrument as claimed in claim 5 wherein said saddle includes a plurality of adjacent saddle members, one for each string.

15. The musical instrument as claimed in claim 14 wherein said saddle comprises a common lower saddle member on which said plurality of adjacent saddle members are disposed as upper saddle members, said upper saddle members being longitudinally adjustable on said lower saddle member to provide adjusting of the relative longitudinal positions of said two points of support.

16. The musical instrument as claimed in claim 15 comprising grooved engaging surfaces on said upper and lower saddle members enabling said upper and lower saddle members to be adjusted in relative longitudinal position and to be fixed in the adjusted longitudinal position.

17. The musical instrument as claimed in claim 16 wherein for each string two upper saddle members are mounted on said lower saddle member, each upper saddle member providing one of said two points of support.

18. The musical instrument as claimed in claim 5 wherein said means for adjusting the relative longitudinal positions of said two points of support comprises a threaded connection between the base and saddle.

19. The musical instrument as claimed in claim 5 wherein said base has a support surface for said saddle on which said saddle is longitudinally adjustable, said support surface being inclined with respect to said sound board.

20. The musical instrument as claimed in claim 5 comprising sound transducer means operationly coupled to said instrument for receiving vibration of the strings.

21. The musical instrument as claimed in claim 5 wherein said instrument includes a neck extending from the resonating box, said tuning means being on said neck, said neck forming a downward angle with respect to said sound board.

22. The musical instrument as claimed in claim 5 wherein said base is made of graphite.

* * * * *